US010283031B2

(12) United States Patent
Herranz et al.

(10) Patent No.: US 10,283,031 B2
(45) Date of Patent: May 7, 2019

(54) ELECTRONIC DEVICE WITH IMAGE PROCESSOR TO REDUCE COLOR MOTION BLUR

(71) Applicant: Apple Inc., Cupertino, CA (US)

(72) Inventors: Adria Fores Herranz, San Jose, CA (US); Cheng Chen, San Jose, CA (US); Jiaying Wu, San Jose, CA (US); Nicholas G. Roland, San Jose, CA (US)

(73) Assignee: Apple Inc., Cupertino, CA (US)

( * ) Notice: Subject to any disclaimer, the term of this patent is extended or adjusted under 35 U.S.C. 154(b) by 131 days.

(21) Appl. No.: 14/848,769

(22) Filed: Sep. 9, 2015

(65) Prior Publication Data

US 2016/0293085 A1 Oct. 6, 2016

Related U.S. Application Data

(60) Provisional application No. 62/142,202, filed on Apr. 2, 2015.

(51) Int. Cl.
*G09G 3/20* (2006.01)
*G09G 3/36* (2006.01)
(Continued)

(52) U.S. Cl.
CPC ..... *G09G 3/2003* (2013.01); *G09G 3/2092* (2013.01); *G09G 3/3607* (2013.01);
(Continued)

(58) Field of Classification Search
CPC ..... G09G 3/2014; G09G 3/2018; G09G 3/00; G09G 2300/0413; G09G 2300/0439; G09G 2300/0443; G09G 2300/0447; G09G 2300/0452; G09G 2300/0456; G09G 2300/046; G09G 2300/0465; G09G 2300/0469; G09G 2300/0473; G09G 3/2033; G09G 3/2037; G09G 3/2029; G09G 2310/0213; G09G 2320/0285;
(Continued)

(56) References Cited

U.S. PATENT DOCUMENTS 4,701,026 A * 10/1987 Yazaki ..... G09G 3/3629 345/208
5,061,044 A * 10/1991 Matsunaga ..... G02F 1/141 345/89

(Continued)

*Primary Examiner* — Grant Sitta
(74) *Attorney, Agent, or Firm* — Treyz Law Group, P.C.; G. Victor Treyz; Joseph F. Guihan

(57) ABSTRACT

An electronic device may generate content that is to be displayed on a display. The display may have an array of pixels each of which includes subpixels of different colors. The content that is to be displayed on the display may include an object such as a black object that is moved across a background. Due to differences in subpixel values in the background for subpixels of different colors, there is a potential for color motion blur to develop along a trailing edge portion of the object as the object is moved across the background. The electronic device may have a blur abatement image processor that processes the content to reduce color motion blur. The blur abatement image processor may identify which pixels are located in the trailing edge and may adjust subpixel values for pixels in the trailing edge.

20 Claims, 11 Drawing Sheets

(51) Int. Cl.
*G09G 5/00* (2006.01)
*G09G 5/02* (2006.01)

(52) U.S. Cl.
CPC ..... *G09G 3/3648* (2013.01); *G09G 5/003* (2013.01); *G09G 5/02* (2013.01); *G09G 2320/0242* (2013.01); *G09G 2320/0252* (2013.01); *G09G 2320/0261* (2013.01); *G09G 2340/16* (2013.01)

(58) Field of Classification Search
CPC .... G09G 3/2051; G09G 3/207; G09G 3/2074; G09G 3/003; G09G 2340/0457; G09G 5/02; G09G 5/003; G09G 3/3607; G09G 3/2092; G09G 3/3648; G09G 2340/16; G09G 2320/0261; G09G 2320/0252; G09G 2320/0242; G09G 3/2003
USPC ..... 345/691–697
See application file for complete search history.

(56) References Cited

U.S. PATENT DOCUMENTS 5,418,574 A * 5/1995 Miyabata ..... H04N 9/646 348/253
5,757,349 A * 5/1998 Togashi ..... G09G 3/367 345/208
6,377,232 B1 * 4/2002 Chevet ..... G09G 1/002 345/13
6,496,194 B1 * 12/2002 Mikoshiba ..... G09G 3/2029 345/596
7,042,422 B2 * 5/2006 Weitbruch ..... G09G 3/2029 315/169.4
7,652,250 B2 * 1/2010 Erdtmann ..... H04N 5/33 250/332
7,773,060 B2 * 8/2010 Oh ..... G09G 5/02 345/690
7,782,338 B1 * 8/2010 Zaklika ..... G06T 11/60 345/619
7,855,710 B2 * 12/2010 Ito ..... G09G 3/2011 313/484
8,174,544 B2 5/2012 Sato et al.
8,390,704 B2 * 3/2013 Wang ..... G06T 5/003 348/248
8,395,613 B2 * 3/2013 Okamoto ..... G09G 3/3233 345/214
8,693,545 B2 * 4/2014 Kim ..... G09G 3/20 375/240.16
8,749,707 B2 * 6/2014 White ..... G09G 3/2022 348/452
9,672,777 B2 * 6/2017 Ji ..... G09G 3/36
2001/0024199 A1 * 9/2001 Hughes ..... G09G 3/3611 345/204
2004/0086193 A1 * 5/2004 Kameyama ..... G06T 3/4053 382/254
2004/0114396 A1 * 6/2004 Kobayashi ..... G02F 1/1336 362/561
2004/0169732 A1 * 9/2004 Weitbruch ..... G09G 3/2003 348/208.13
2004/0196234 A1 * 10/2004 Shiomi ..... G09G 3/3648 345/89
2005/0083353 A1 * 4/2005 Maruyama ..... G09G 3/3611 345/690
2005/0162584 A1 * 7/2005 Yamamoto ..... G09G 3/3413 349/68
2005/0275645 A1 * 12/2005 Shen ..... G09G 3/2011 345/204
2006/0012614 A1 * 1/2006 Asao ..... G02F 1/133514 345/690
2006/0072664 A1 * 4/2006 Kwon ..... G09G 3/20 375/240.16
2006/0192786 A1 * 8/2006 Yamada ..... G09G 3/2003 345/589
2006/0227249 A1 * 10/2006 Chen ..... G09G 3/20 348/631
2006/0284894 A1 * 12/2006 Johnson ..... G09G 3/2022 345/690
2008/0069203 A1 * 3/2008 Karczewicz ..... G06T 3/4007 375/240.01
2008/0074372 A1 * 3/2008 Baba ..... G09G 3/3406 345/89
2008/0279470 A1 * 11/2008 Warmuth ..... G09G 3/3611 382/255
2009/0009455 A1 * 1/2009 Kimura ..... G09G 3/2074 345/89
2009/0122188 A1 * 5/2009 Hanaoka ..... G09G 3/3648 348/459
2009/0153743 A1 * 6/2009 Arashima ..... G09G 3/3648 348/699
2009/0184894 A1 * 7/2009 Sato ..... G09G 3/2803 345/60
2009/0185078 A1 * 7/2009 Van Beek ..... G06T 3/4007 348/624
2010/0026904 A1 * 2/2010 Higuchi ..... H04N 5/145 348/700
2010/0039367 A1 * 2/2010 Tai ..... G09G 3/3406 345/102
2010/0097308 A1 * 4/2010 De Greef ..... G09G 3/3413 345/102
2010/0158402 A1 * 6/2010 Nagase ..... G09G 3/20 382/255
2010/0214328 A1 * 8/2010 Hara ..... G09G 3/2025 345/690
2010/0265395 A1 * 10/2010 Correa ..... G09G 3/2003 348/455
2010/0271515 A1 * 10/2010 Imagawa ..... H04N 5/144 348/266
2010/0295763 A1 * 11/2010 Chen ..... G09G 3/3611 345/89
2011/0033130 A1 * 2/2011 Poon ..... G06T 5/003 382/255
2012/0162156 A1 * 6/2012 Chen ..... G09G 3/3648 345/204
2012/0162528 A1 * 6/2012 Kiuchi ..... G09G 3/20 348/607
2013/0002947 A1 * 1/2013 Mikhalenkov ..... H04N 7/0127 348/441
2013/0071028 A1 * 3/2013 Schiller ..... G06T 5/003 382/180
2013/0093906 A1 * 4/2013 Carlsson ..... H04N 5/23258 348/208.99
2013/0251282 A1 * 9/2013 Min ..... G06T 5/002 382/260
2014/0176406 A1 * 6/2014 Guo ..... G09G 3/3688 345/87
2014/0253422 A1 * 9/2014 Tomizawa ..... G02F 1/133514 345/88
2014/0266996 A1 * 9/2014 Slavenburg ..... G06F 3/147 345/102
2015/0162528 A1 * 6/2015 Franceschini ..... H01L 45/1226 257/4
2016/0247439 A1 * 8/2016 Fan ..... G09G 3/36

* cited by examiner

ELECTRONIC DEVICE WITH IMAGE PROCESSOR TO REDUCE COLOR MOTION BLUR

This application claims the benefit of provisional patent application No. 62/142,202 filed on Apr. 2, 2015, which is hereby incorporated by reference herein in its entirety.

BACKGROUND

This relates generally to electronic devices, and more particularly, to electronic devices with displays.

Electronic devices often include displays. For example, cellular telephones and portable computers often include displays for presenting information to a user.

Liquid crystal displays contain a layer of liquid crystal material. Pixels in a liquid crystal display contain thin-film transistors and electrodes for applying electric fields to the liquid crystal material. The strength of the electric field in a pixel controls the polarization state of the liquid crystal material and thereby adjusts the brightness of the pixel.

The speed with which liquid crystal pixels switch can vary as a function of applied voltage. As a result, the amount of time required to switch a black pixel to a gray level will be longer than the amount of time required to switch a black pixel to a white level. In some situations, it may be desirable to move a black object on a screen with a colored background. In this type of scenario, subpixels of different colors may have different target pixel values and may therefore switch at different speeds. This may result in unpleasant color motion blur effects as the black object is moved.

It would therefore be desirable to be able to provide improved displays for electronic devices such as displays with reduced color motion blur.

SUMMARY

An electronic device may generate content that is to be displayed on a display. The display may have an array of pixels each of which includes subpixels of different colors. The content that is to be displayed on the display may include an object such as a black object that is moved across a background. Due to differences in subpixel values in the background for subpixels of different colors, there is a potential for color motion blur to develop along a trailing edge of the object as the object is moved across the background. The electronic device may have a blur abatement image processor that processes the content to reduce color motion blur. The blur abatement image processor may identify which pixels are located in the trailing edge and may adjust subpixel values in the trailing edge.

The subpixels may include red subpixels, green subpixels, and blue subpixels. The values of the subpixels of different colors may be different in the background. For example, the background may have a red subpixel value that is greater than green and blue subpixel values. To slow the red subpixel transition speed relative to the green and blue subpixel transmission speeds, the blur abatement image processor may momentarily adjust the red subpixel value for pixels in the trailing edge by setting the red subpixel value to a lower value such as that of the green subpixel in the background. The blur abatement image processor may then raise the temporarily lowered red subpixel value to its desired final target value in the background.

DETAILED DESCRIPTION

Electronic devices may include displays. The displays may be used to display images to a user. Illustrative electronic devices that may be provided with displays are shown in FIGS. 1, 2, 3, and 4.

Figure 1:
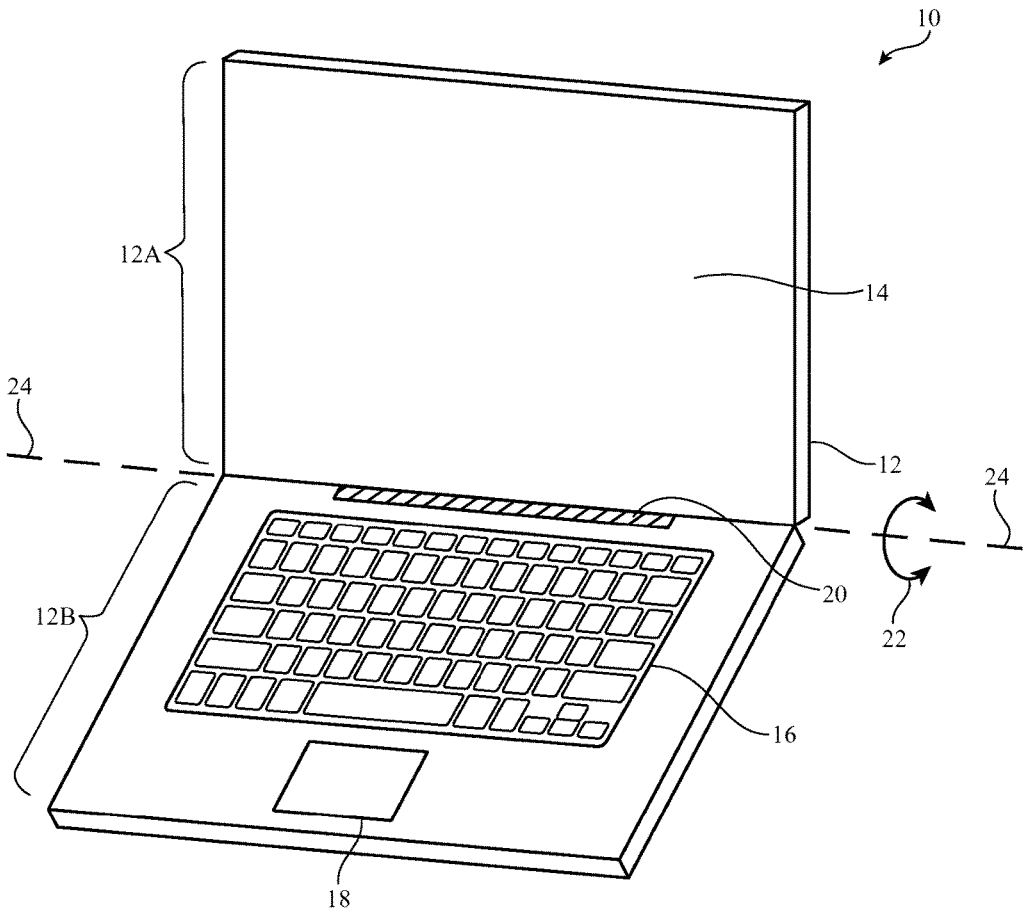
FIG. 1 is a perspective view of an illustrative electronic device such as a laptop computer with a display in accordance with an embodiment.

FIG. 1 shows how electronic device 10 may have the shape of a laptop computer having upper housing 12A and lower housing 12B with components such as keyboard 16 and touchpad 18. Device 10 may have hinge structures 20 that allow upper housing 12A to rotate in directions 22 about rotational axis 24 relative to lower housing 12B. Display 14 may be mounted in upper housing 12A. Upper housing 12A, which may sometimes referred to as a display housing or lid, may be placed in a closed position by rotating upper housing 12A towards lower housing 12B about rotational axis 24.

Figure 2:
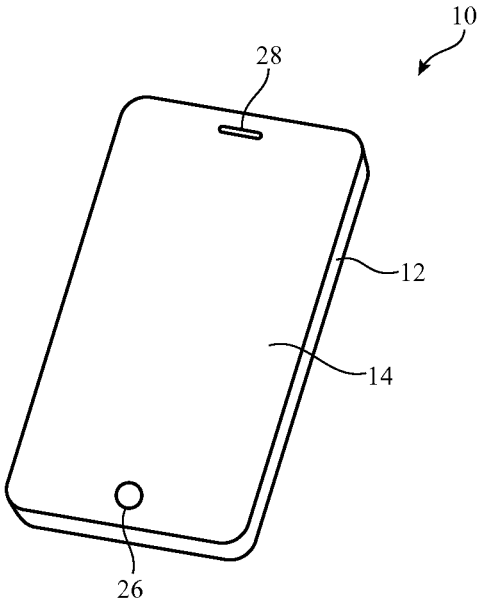
FIG. 2 is a perspective view of an illustrative electronic device such as a handheld electronic device with a display in accordance with an embodiment.

FIG. 2 shows how electronic device 10 may be a handheld device such as a cellular telephone, music player, gaming device, navigation unit, or other compact device. In this type of configuration for device 10, housing 12 may have opposing front and rear surfaces. Display 14 may be mounted on a front face of housing 12. Display 14 may, if desired, have openings for components such as button 26. Openings may also be formed in display 14 to accommodate a speaker port (see, e.g., speaker port 28 of FIG. 2).

Figure 3:
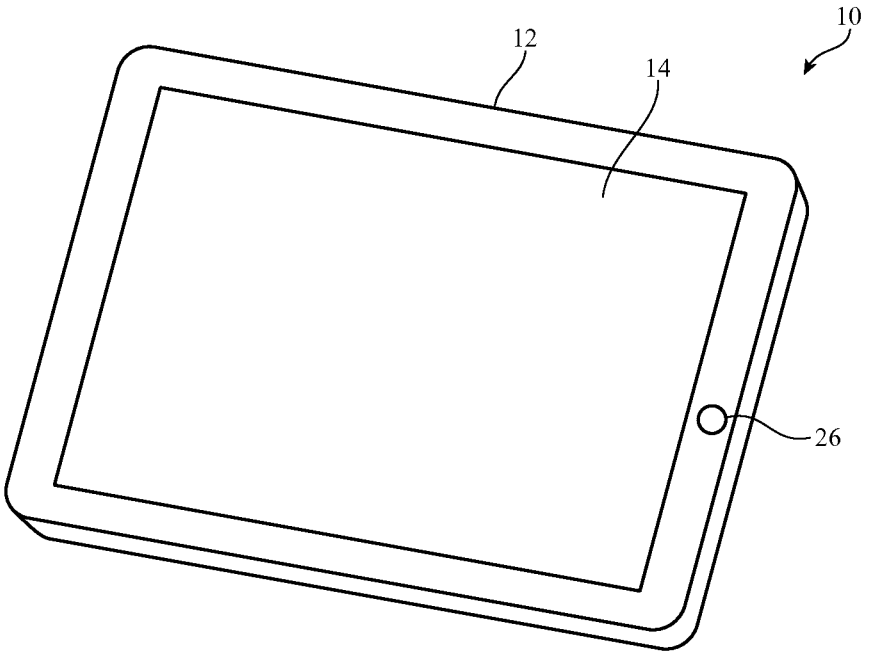
FIG. 3 is a perspective view of an illustrative electronic device such as a tablet computer with a display in accordance with an embodiment.

FIG. 3 shows how electronic device 10 may be a tablet computer. In electronic device 10 of FIG. 3, housing 12 may have opposing planar front and rear surfaces. Display 14 may be mounted on the front surface of housing 12. As shown in FIG. 3, display 14 may have an opening to accommodate button 26 (as an example).

Figure 4:
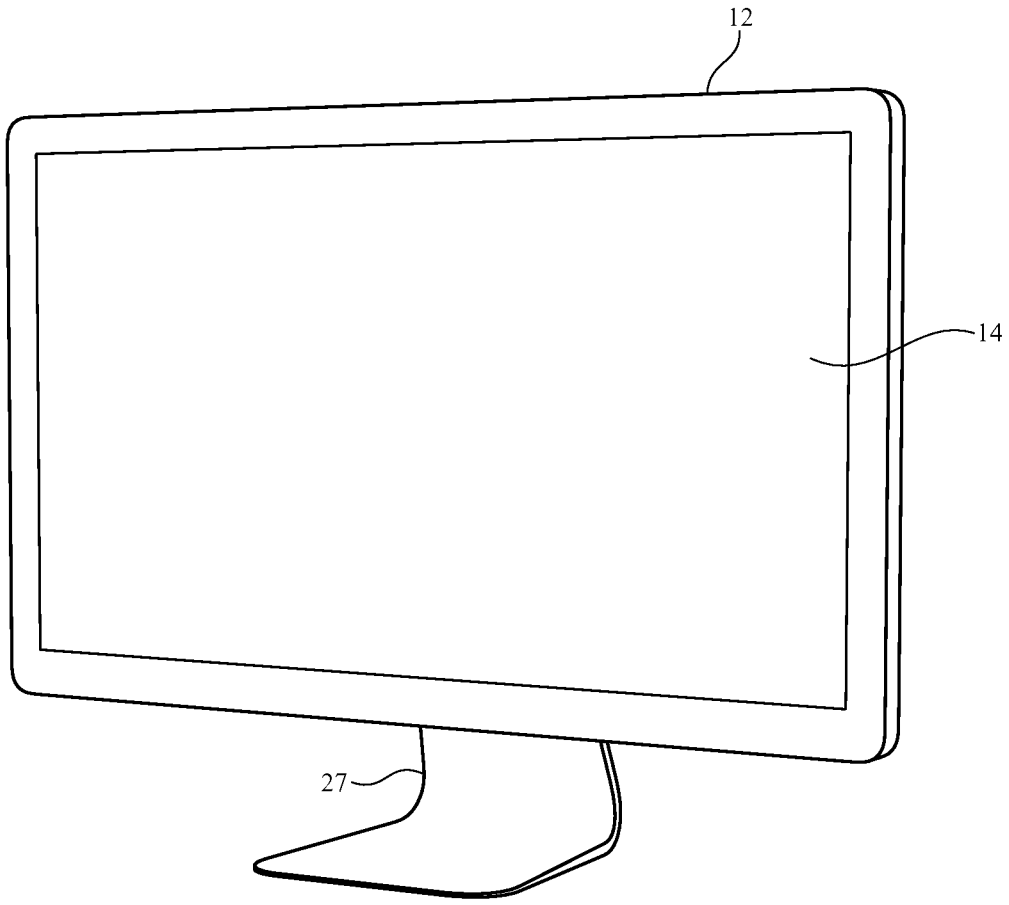
FIG. 4 is a perspective view of an illustrative electronic device such as a computer display with display structures in accordance with an embodiment.

FIG. 4 shows how electronic device 10 may be a display such as a computer display or other display or may be a computer that has been integrated into a computer display. With this type of arrangement, housing 12 for device 10 may be mounted on a support structure such as stand 27 or stand 27 may be omitted (e.g., to mount device 10 on a wall). Display 14 may be mounted on a front face of housing 12.

The illustrative configurations for device 10 that are shown in FIGS. 1, 2, 3, and 4 are merely illustrative. In general, electronic device 10 may be a laptop computer, a computer monitor containing an embedded computer, a tablet computer, a cellular telephone, a media player, or other handheld or portable electronic device, a smaller device such as a wrist-watch device, a pendant device, a headphone or earpiece device, or other wearable or miniature device, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

Housing 12 of device 10, which is sometimes referred to as a case, may be formed of materials such as plastic, glass, ceramics, carbon-fiber composites and other fiber-based composites, metal (e.g., machined aluminum, stainless steel, or other metals), other materials, or a combination of these materials. Device 10 may be formed using a unibody construction in which most or all of housing 12 is formed from a single structural element (e.g., a piece of machined metal or a piece of molded plastic) or may be formed from multiple housing structures (e.g., outer housing structures that have been mounted to internal frame elements or other internal housing structures).

Display 14 may be a touch sensitive display that includes a touch sensor or may be insensitive to touch. Touch sensors for display 14 may be formed from an array of capacitive touch sensor electrodes, a resistive touch array, touch sensor structures based on acoustic touch, optical touch, or force-based touch technologies, or other suitable touch sensor components.

Display 14 for device 10 may include pixels formed from liquid crystal display (LCD) components. A display cover layer may cover the surface of display 14 or a display layer such as a color filter layer or other portion of a display may be used as the outermost (or nearly outermost) layer in display 14. The outermost display layer may be formed from a transparent glass sheet, a clear plastic layer, or other transparent member.

Figure 5:
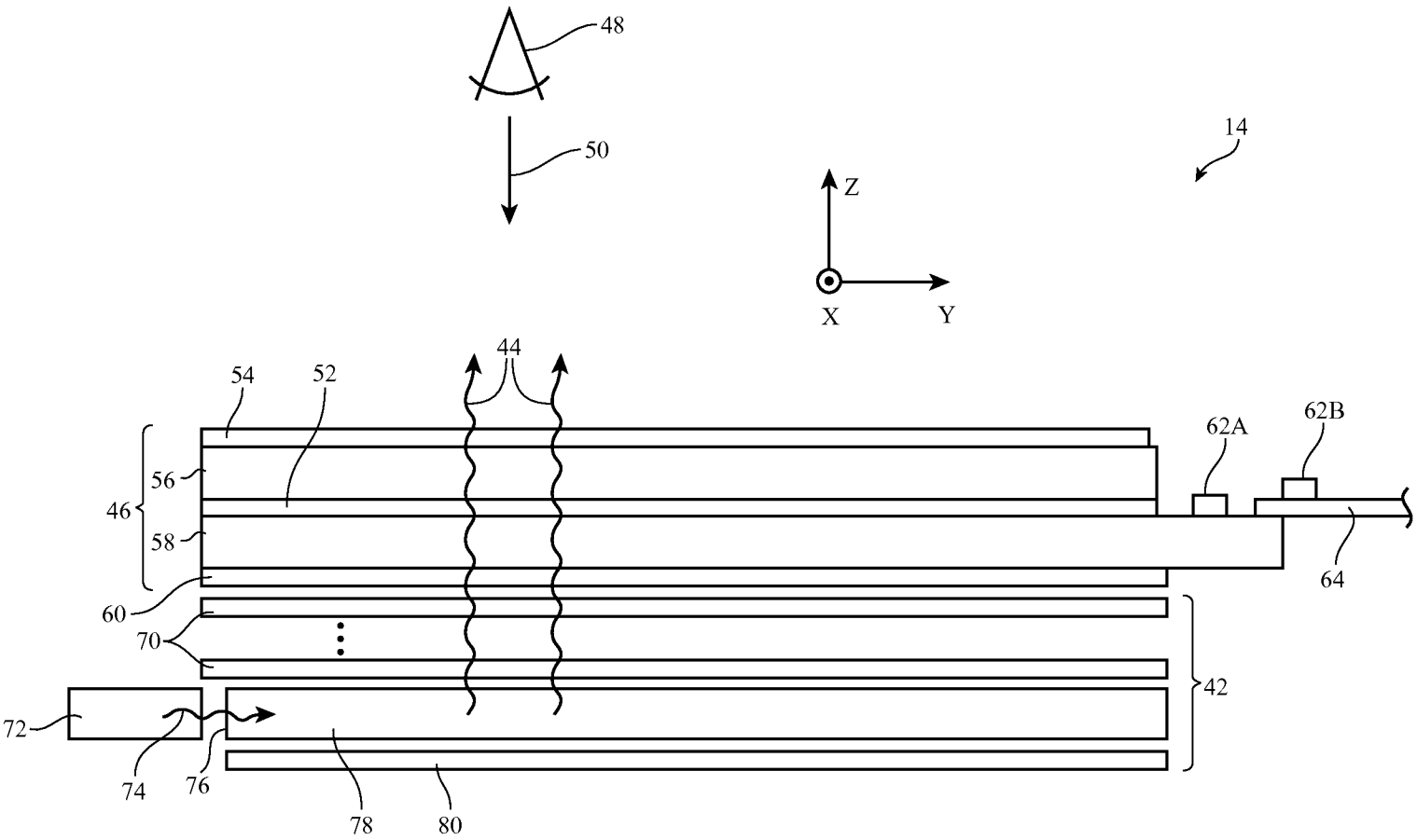
FIG. 5 is a cross-sectional side view of an illustrative display in accordance with an embodiment.

A cross-sectional side view of an illustrative configuration for display 14 of device 10 (e.g., for display 14 of the devices of FIG. 1, FIG. 2, FIG. 3, FIG. 4 or other suitable electronic devices) is shown in FIG. 5. As shown in FIG. 5, display 14 may include backlight structures such as backlight unit 42 for producing backlight 44. During operation, backlight 44 travels outwards (vertically upwards in dimension Z in the orientation of FIG. 5) and passes through display pixel structures in display layers 46. This illuminates any images that are being produced by the display pixels for viewing by a user. For example, backlight 44 may illuminate images on display layers 46 that are being viewed by viewer 48 in direction 50.

Display layers 46 may be mounted in chassis structures such as a plastic chassis structure and/or a metal chassis structure to form a display module for mounting in housing 12 or display layers 46 may be mounted directly in housing 12 (e.g., by stacking display layers 46 into a recessed portion in housing 12). Display layers 46 may form a liquid crystal display or may be used in forming displays of other types.

Display layers 46 may include a liquid crystal layer such a liquid crystal layer 52. Liquid crystal layer 52 may be sandwiched between display layers such as display layers 58 and 56. Layers 56 and 58 may be interposed between lower polarizer layer 60 and upper polarizer layer 54.

Layers 58 and 56 may be formed from transparent substrate layers such as clear layers of glass or plastic. Layers 58 and 56 may be layers such as a thin-film transistor layer and/or a color filter layer. Conductive traces, color filter elements, transistors, and other circuits and structures may be formed on the substrates of layers 58 and 56 (e.g., to form a thin-film transistor layer and/or a color filter layer). Touch sensor electrodes may also be incorporated into layers such as layers 58 and 56 and/or touch sensor electrodes may be formed on other substrates.

With one illustrative configuration, layer 58 may be a thin-film transistor layer that includes an array of pixel circuits based on thin-film transistors and associated electrodes (pixel electrodes) for applying electric fields to liquid crystal layer 52 and thereby displaying images on display 14. Layer 56 may be a color filter layer that includes an array of color filter elements for providing display 14 with the ability to display color images. If desired, layer 58 may be a color filter layer and layer 56 may be a thin-film transistor layer. Configurations in which color filter elements are combined with thin-film transistor structures on a common substrate layer in the upper or lower portion of display 14 may also be used.

During operation of display 14 in device 10, control circuitry (e.g., one or more integrated circuits on a printed circuit) may be used to generate information to be displayed on display 14 (e.g., display data). The information to be displayed may be conveyed to a display driver integrated circuit such as circuit 62A or 62B using a signal path such as a signal path formed from conductive metal traces in a rigid or flexible printed circuit such as printed circuit 64 (as an example).

Backlight structures 42 may include a light guide plate such as light guide plate 78. Light guide plate 78 may be formed from a transparent material such as clear glass or plastic. During operation of backlight structures 42, a light source such as light source 72 may generate light 74. Light source 72 may be, for example, an array of light-emitting diodes.

Light 74 from light source 72 may be coupled into edge surface 76 of light guide plate 78 and may be distributed in dimensions X and Y throughout light guide plate 78 due to the principal of total internal reflection. Light guide plate 78 may include light-scattering features such as pits or bumps. The light-scattering features may be located on an upper surface and/or on an opposing lower surface of light guide plate 78. Light source 72 may be located at the left of light guide plate 78 as shown in FIG. 5 or may be located along the right edge of plate 78 and/or other edges of plate 78.

Light 74 that scatters upwards in direction Z from light guide plate 78 may serve as backlight 44 for display 14. Light 74 that scatters downwards may be reflected back in the upwards direction by reflector 80. Reflector 80 may be formed from a reflective material such as a layer of plastic covered with a dielectric mirror thin-film coating.

To enhance backlight performance for backlight structures 42, backlight structures 42 may include optical films 70. Optical films 70 may include diffuser layers for helping to homogenize backlight 44 and thereby reduce hotspots, compensation films for enhancing off-axis viewing, and brightness enhancement films (also sometimes referred to as turning films) for collimating backlight 44. Optical films 70 may overlap the other structures in backlight unit 42 such as light guide plate 78 and reflector 80. For example, if light guide plate 78 has a rectangular footprint in the X-Y plane of FIG. 5, optical films 70 and reflector 80 may have a matching rectangular footprint. If desired, films such as compensation films may be incorporated into other layers of display 14 (e.g., polarizer layers).

Figure 6:
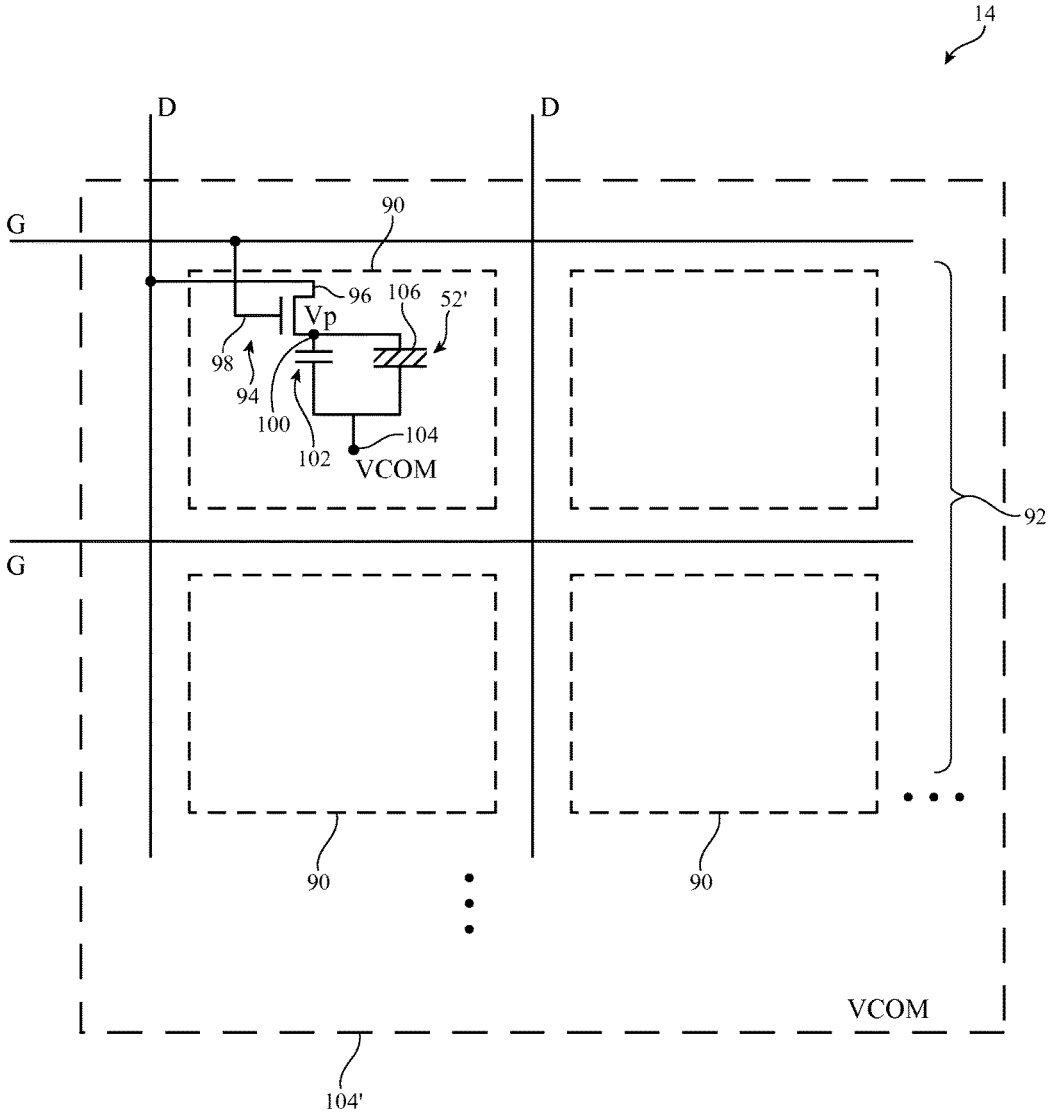
FIG. 6 is a top view of a portion of an array of pixels in a display in accordance with an embodiment.

As shown in FIG. 6, display 14 may include an array of pixels 90 such as pixel array 92. Pixel array 92 may be controlled using control signals produced by display driver circuitry. Display driver circuitry may be implemented using one or more integrated circuits (ICs) and/or thin-film transistors or other circuitry.

During operation of device 10, control circuitry in device 10 such as memory circuits, microprocessors, and other storage and processing circuitry may provide data to the display driver circuitry. The display driver circuitry may convert the data into signals for controlling pixels 90 of pixel array 92.

Pixel array 92 may contain rows and columns of pixels 90. The circuitry of pixel array 92 (i.e., the rows and columns of pixel circuits for pixels 90) may be controlled using signals such as data line signals on data lines D and gate line signals on gate lines G. Data lines D and gate lines G are orthogonal. For example, data lines D may extend vertically and gate lines G may extend horizontally (i.e., perpendicular to data lines D).

Pixels 90 in pixel array 92 may contain thin-film transistor circuitry (e.g., polysilicon transistor circuitry, amorphous silicon transistor circuitry, semiconducting-oxide transistor circuitry such as InGaZnO transistor circuitry, other silicon or semiconducting-oxide transistor circuitry, etc.) and associated structures for producing electric fields across liquid crystal layer 52 in display 14. Each display pixel may have one or more thin-film transistors. For example, each display pixel may have a respective thin-film transistor such as thin-film transistor 94 to control the application of electric fields to a respective pixel-sized portion 52' of liquid crystal layer 52.

The thin-film transistor structures that are used in forming pixels 90 may be located on a thin-film transistor substrate such as a layer of glass. The thin-film transistor substrate and the structures of display pixels 90 that are formed on the surface of the thin-film transistor substrate collectively form thin-film transistor layer 58 (FIG. 5).

Gate driver circuitry may be used to generate gate signals on gate lines G. The gate driver circuitry may be formed from thin-film transistors on the thin-film transistor layer or may be implemented in separate integrated circuits. The data line signals on data lines D in pixel array 92 carry analog image data (e.g., voltages with magnitudes representing pixel brightness levels). During the process of displaying images on display 14, a display driver integrated circuit or other circuitry may receive digital data from control circuitry and may produce corresponding analog data signals. The analog data signals may be demultiplexed and provided to data lines D.

The data line signals on data lines D are distributed to the columns of display pixels 90 in pixel array 92. Gate line signals on gate lines G are provided to the rows of pixels 90 in pixel array 92 by associated gate driver circuitry.

The circuitry of display 14 may be formed from conductive structures (e.g., metal lines and/or structures formed from transparent conductive materials such as indium tin oxide) and may include transistors such as transistor 94 of FIG. 6 that are fabricated on the thin-film transistor substrate layer of display 14. The thin-film transistors may be, for example, silicon thin-film transistors or semiconducting-oxide thin-film transistors.

As shown in FIG. 6, pixels such as pixel 90 may be located at the intersection of each gate line G and data line D in array 92. A data signal on each data line D may be supplied to terminal 96 from one of data lines D. Thin-film transistor 94 (e.g., a thin-film polysilicon transistor, an amorphous silicon transistor, or an oxide transistor such as a transistor formed from a semiconducting oxide such as indium gallium zinc oxide) may have a gate terminal such as gate 98 that receives gate line control signals on gate line G. When a gate line control signal is asserted, transistor 94 will be turned on and the data signal at terminal 96 will be passed to node 100 as pixel voltage Vp. Data for display 14 may be displayed in frames. Following assertion of the gate line signal in each row to pass data signals to the pixels of that row, the gate line signal may be deasserted. In a subsequent display frame, the gate line signal for each row may again be asserted to turn on transistor 94 and capture new values of Vp.

Pixel 90 may have a signal storage element such as capacitor 102 or other charge storage elements. Storage capacitor 102 may be used to help store signal Vp in pixel 90 between frames (i.e., in the period of time between the assertion of successive gate signals).

Display 14 may have a common electrode coupled to node 104. The common electrode (which is sometimes referred to as the common voltage electrode, Vcom electrode, or Vcom terminal) may be used to distribute a common electrode voltage such as common electrode voltage Vcom to nodes such as node 104 in each pixel 90 of array 92. As shown by illustrative electrode pattern 104' of FIG. 6, Vcom electrode 104 may be implemented using a blanket film of a transparent conductive material such as indium tin oxide, indium zinc oxide, other transparent conductive oxide material, and/or a layer of metal that is sufficiently thin to be transparent (e.g., electrode 104 may be formed from a layer of indium tin oxide or other transparent conductive layer that covers all of pixels 90 in array 92).

In each pixel 90, capacitor 102 may be coupled between nodes 100 and 104. A parallel capacitance arises across nodes 100 and 104 due to electrode structures in pixel 90 that are used in controlling the electric field through the liquid crystal material of the pixel (liquid crystal material 52'). As shown in FIG. 6, electrode structures 106 (e.g., a display pixel electrode with multiple fingers or other display pixel electrode for applying electric fields to liquid crystal material 52') may be coupled to node 100 (or a multi-finger display pixel electrode may be formed at node 104). During operation, electrode structures 106 may be used to apply a controlled electric field (i.e., a field having a magnitude proportional to Vp-Vcom) across pixel-sized liquid crystal material 52' in pixel 90. Due to the presence of storage capacitor 102 and the parallel capacitances formed by the pixel structures of pixel 90, the value of Vp (and therefore the associated electric field across liquid crystal material 52') may be maintained across nodes 106 and 104 for the duration of the frame.

The electric field that is produced across liquid crystal material 52' causes a change in the orientations of the liquid crystals in liquid crystal material 52'. This changes the polarization of light passing through liquid crystal material 52'. The change in polarization may, in conjunction with polarizers 60 and 54 of FIG. 5, be used in controlling the amount of light 44 that is transmitted through each pixel 90 in array 92 of display 14.

In displays such as color displays, color filter layer 56 is used to impart different colors to different pixels. As an example, each pixel in display 14 may contain three (or more than three) different subpixels (pixels 90) each with a different respective color. With one suitable arrangement, which may sometimes be described herein as an example, each pixel has a red subpixel, a green subpixel, and a blue subpixel. Each subpixel is driven with an independently selected pixel voltage Vp. The amount of voltage that is supplied to the electrodes of each subpixel is associated with a respective digital pixel value (e.g., a value ranging from 0 to 255 or other suitable digital range). Desired pixel colors may be produced by adjusting the pixel values for each of the three subpixels in a pixel. For example, a black pixel may be associated with a 0 pixel value for the red subpixel, a 0 pixel value for the green subpixel, and a 0 pixel value for the blue subpixel. As another example, an orange pixel may be associated with pixel values of 245, 177, and 100 for the red, green, and blue subpixels. White may be represented by pixel values of 255, 255, and 255.

The response times of the pixels in display 14 may vary as a function of the magnitude of the liquid crystal switching voltage applied to electrodes 106. When switching a black pixel, which has red, green, blue pixel values of (0, 0, 0), to a white pixel (255, 255, 255), each subpixel (red, green, and blue) is provided with the same target pixel value (i.e., 255) and starts from the same initial pixel value (i.e., 0), so the voltage applied across liquid crystal layer 52 during switching is the same for each subpixel. As a result, all subpixels will switch at the same time. This type of switching scenario may arise when moving black text, a black cursor, or other black item against a white background.

Other pixel switching scenarios may create color motion blur due to the unequal response times that arise when driving subpixels of different colors with different pixel values. As an example, consider the response of a pixel when switching from black (0, 0, 0) to orange (245, 177, 100). In this situation, a large voltage drop appears across the red subpixel (i.e., a voltage drop associated with a difference in before and after digital values of 245) and lower voltage drops appear across the green subpixel (a voltage associated with pixel value change of 177) and blue subpixel (a pixel value change of 100). Because the voltage on the red subpixel (and therefore the electric field applied by the red electrode 106 to the liquid crystal layer) is relatively large, the liquid crystal molecules of the red subpixel will rotate more quickly than the liquid crystal molecules of the green and blue subpixels. The red subpixel will therefore change color (from black to red) faster than the green and blue subpixels will switch from black to green and black to blue, respectively. The disparate switching speeds of the subpixels of different colors can lead to unpleasant visual artifacts. In the present example, in which a black item is being moved across an orange background, the relatively faster switching speed of the red subpixels has the potential to create undesirable red motion blur effects.

Figure 7:
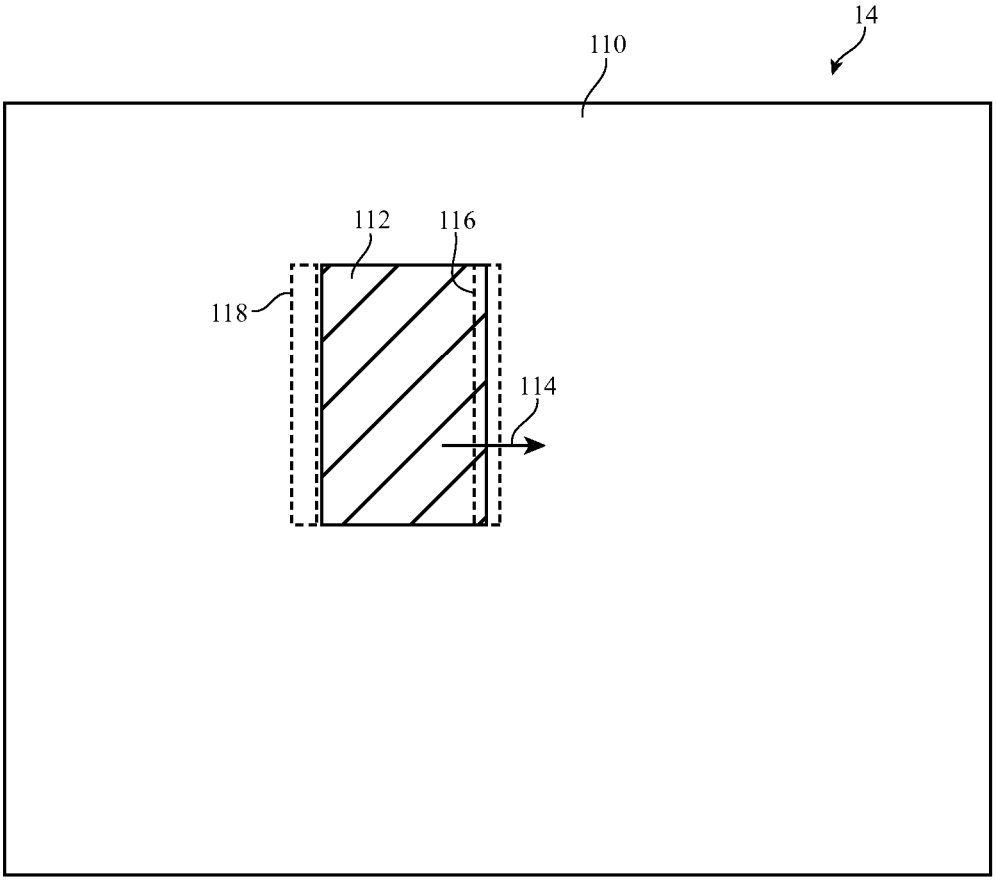
FIG. 7 is a diagram showing how motion of an object against a background has the potential to discolor pixels along the edges of the object and thereby create color motion blur effects.

Color motion blur effects can arise both at the leading edge of a moving object and at the trailing edge of a moving object. For example, consider the movement of object 112 across background 110 of display 14 of FIG. 7. Object 112 may have a first color (e.g., black) and background 110 may have a second color (e.g., orange). Object 112 may be black text (as an example). Background 110 may have a color that is desirable when presenting electronic books to a user in a warm ambient lighting environment (e.g., indoor lighting). Object 112 may be moved across background 110 up and down during scrolling, right and left when panning, etc. In the example of FIG. 7, object 112 is moving to the right in direction 114.

At trailing edge 118, black pixels (0, 0, 0) are being switched to orange (245, 177, 100). Black-to-white switching speeds (rise times) may vary considerably depending on switching voltage levels. Because the red pixels are provided with a larger switching voltage than the green and blue pixels when switching from black to orange, the red pixels in region 116 may switch from black more quickly than the green and blue pixels, leading to blurred colors in region 118. In particular, the pixels of display 14 in region 118 have the potential to develop a significant red color due to the enhanced switching speed of the red subpixels relative to the blue and green subpixels.

At leading edge 116 of object 112, pixels are switching from background color 110 to the color of object 112. For example, pixels in leading edge 116 may be switching from background color 110 (245, 177, 100) to black (0, 0, 0). The red pixels in this situation may exhibit slightly slower decay times than the green and blue pixels, leading to gray motion blur.

Figure 8:
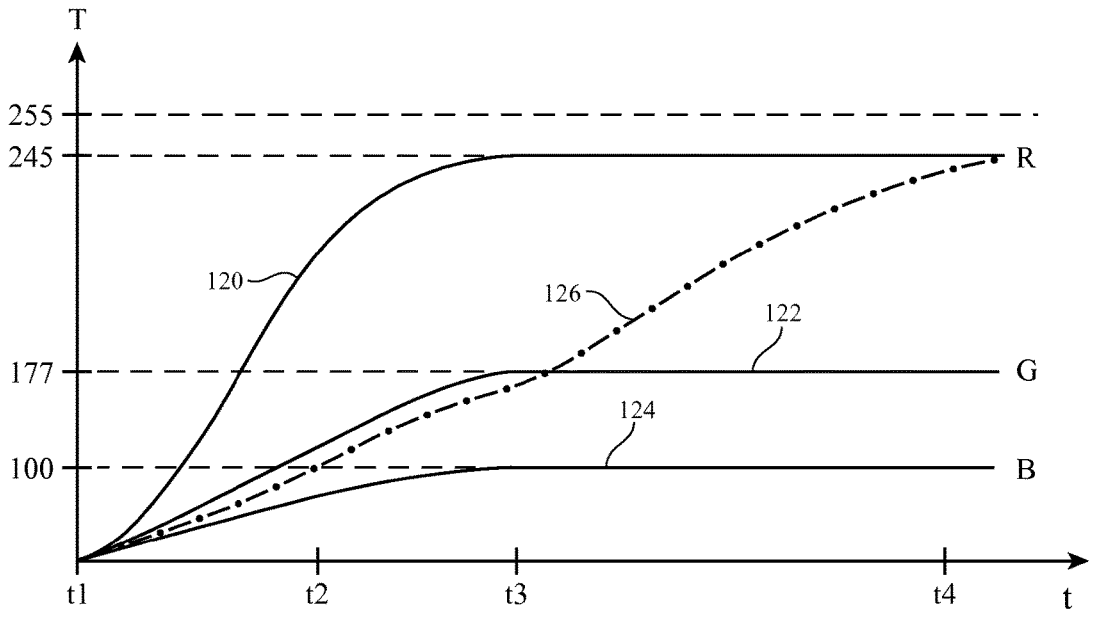
FIG. 8 is a graph showing how red, green, and blue subpixels in a display may have different target pixel values during color transitions such as those associated with movement of the object of FIG. 7 and therefore have the potential to switch at different speeds in accordance with an embodiment.

A graph showing how pixels with different colors have the potential to switch at different speeds during particular color transitions is shown in the graph of FIG. 8 in which subpixel transmission T (proportional to subpixel output intensity) has been plotted as a function of time t. In the example of FIG. 8, the situation at trailing edge 118 of FIG. 7 is being illustrated. Initially (at time t1), the pixels are black (0, 0, 0). At time t3, object 112 has moved away from edge 118 and each of the subpixels have had sufficient time (in conventional displays) to acquire their desired target value (i.e., the red subpixel can acquire value 245, the green subpixel can acquire value 177, and the blue subpixel can acquire value 100). The switching progress of the red, green, and blue subpixels in a conventional display is illustrated by curves 120 (for red), 122 (for green), and 124 (for blue). These curves (which are not normalized in the graph of FIG. 8) exhibit transitions at different speeds. The green and blue curves 122 and 124 transition relatively slowly. The red curve (curve 120) transitions rapidly, because the target value for the red subpixel is relatively high (245). Because red curve 120 rises steeply compared with green curve 122 and blue curve 124, the color of the pixels in trailing edge 118 at times such as time t2 before the green and blue subpixels have reached their target values will be overly red in color in conventional displays.

To restore the desired balance between the red, green, and blue subpixels in trailing edge 118 and therefore minimize red motion blur effects, red subpixel transitions may be momentarily slowed down in display 14 relative to the green and blue subpixel transitions in trailing edge 118. This may be accomplished by creating an image frame for display 14 in which the target values for the red subpixels in trailing edge 118 are temporarily set to a reduced target value. The reduced target value may be, for example, the value of the next highest subpixel value (i.e., the green subpixel target value of 177 in the present example). Because the red subpixel has a lowered target pixel value, the red subpixel will not switch at an overly fast rate relative to the green and blue subpixels and red color motion blur will be suppressed. After processing the image frame with the temporarily reduced red subpixel target values, display 14 may be presented with a frame of image data in which the red subpixels are provided with their desired final target values (i.e., 245 in the present example). Because the green and blue subpixels have already at least partly transitioned to their final target values, the red subpixels can transition to their final red subpixel target values without risk of introducing red motion blur into trailing edge 118.

Figure 9:
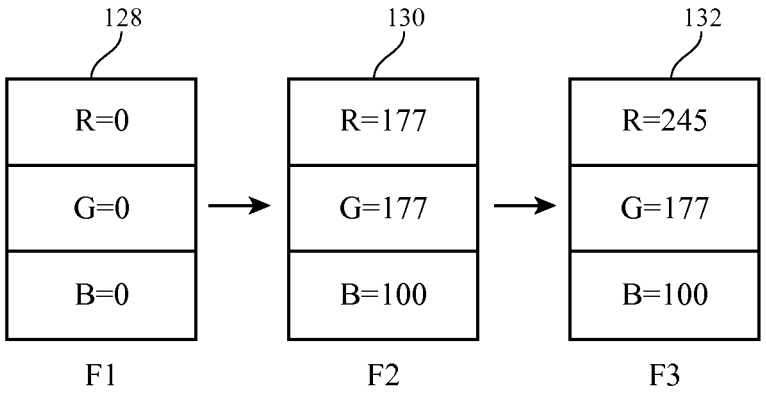
FIG. 9 is a diagram showing how the trailing edge of a moving object may be temporarily provided with modified subpixel values to reduce color motion blur effects in accordance with an embodiment.

FIG. 9 illustrates how pixels in trailing edge 118 may be provided with intermediate target values to suppress color motion blur. Initially, a pixel in image frame F1 may have red, green, and blue subpixel values 128 of (0, 0, 0), corresponding to a portion of black item 112. When item 112 is moved, the pixels in trailing edge 118 will need to transition to the color of background 110. In this example, background 110 is orange, so the final target values 132 for the red, green, and blue subpixels of each pixel in trailing edge 118 are (245, 177, 100). This target pixel state will be reached when display 14 displays frame F3. To suppress color motion blur, an intermediate set of target values is temporarily imposed on the pixels in trailing edge 118. The temporary target values for these pixel include a reduced red subpixel value. In the example of FIG. 9, intermediate frame F2 has been provided with temporary target values 130 for the red, green, blue subpixels of (177, 177, 100)—i.e., the red subpixel value has been temporarily reduced to a value equal to the second highest subpixel value in the final target values, which is 177 in this example. Other intermediate subpixel values may be used to suppress motion blur, if desired. For example, the trailing edge pixels in frame F2 may be provided with red subpixel values having values that lie between final target value 245 and the lowest final target subpixel value (100 in this example), that lie between 245 and 177 (the second highest final target subpixel value), that lie between 177 and 100, or that are otherwise reduced from the final target value 245. The example of FIG. 9 is merely illustrative.

The impact of introducing an intermediate image frame with temporarily adjusted subpixel values in trailing edge 118 to suppress color motion blur is illustrated by curve 126 of FIG. 8. Initially, at time t1, initial frame F1 has a pixel in object 112 that is black (0, 0, 0). When object 112 is moved, this pixel forms one of the pixels in trailing edge 118 and receives a final target value that is not black. The final target value of the pixel (in this example) is orange (245, 177, 100).

In the absence of intermediate frame F2 at time t3, the red subpixel will transition rapidly relative to the green and blue subpixels as indicated by the rapid rise in curve 120 relative to curves 122 and 124. As a result, trailing edge 118 will exhibit red motion blur at times such as time t2. When an intermediate frame such as frame F2 of FIG. 9 is used (e.g., at time T3), the reduced subpixel target values in the intermediate frame, will cause the red subpixel to transition at a reduced rate, as indicated by curve 126. For example, at time t3, the red subpixel may have a value of 177 (i.e., the same value as the green subpixel). Because the red subpixel transmission between time t1 and time t3 of curve 126 is slower than the conventional red subpixel transition between time t1 and time t3 of curve 120, red motion blur will not be visible at time t2. After intermediate frame F2 has been processed, the pixels in trailing edge 118 may be updated by displaying updated frame F3 at time t4. During the transition period between time t3 and t4, the red subpixel can transition from a value of 177 to its final target value of 245, as indicated by curve 126 between times t3 and t4. The green and blue subpixels have already reached (or nearly reached) their final target values at time t3, so there will not be any excessive red present in trailing edge 118 between time t3 and time t4.

Device 10 may process the image frames being displayed on display 14 to identify which pixel values are associated with trailing edge 118. After the pixels of trailing edge 118 have been identified, the pixels of trailing edge 118 may be provided with intermediate values (i.e., values with reduced red subpixel values) during frame F2 and then final values (i.e., values in which the red subpixels and the other subpixels have their desired final target levels) during frame F3, as described in connection with FIG. 9.

Figure 10:
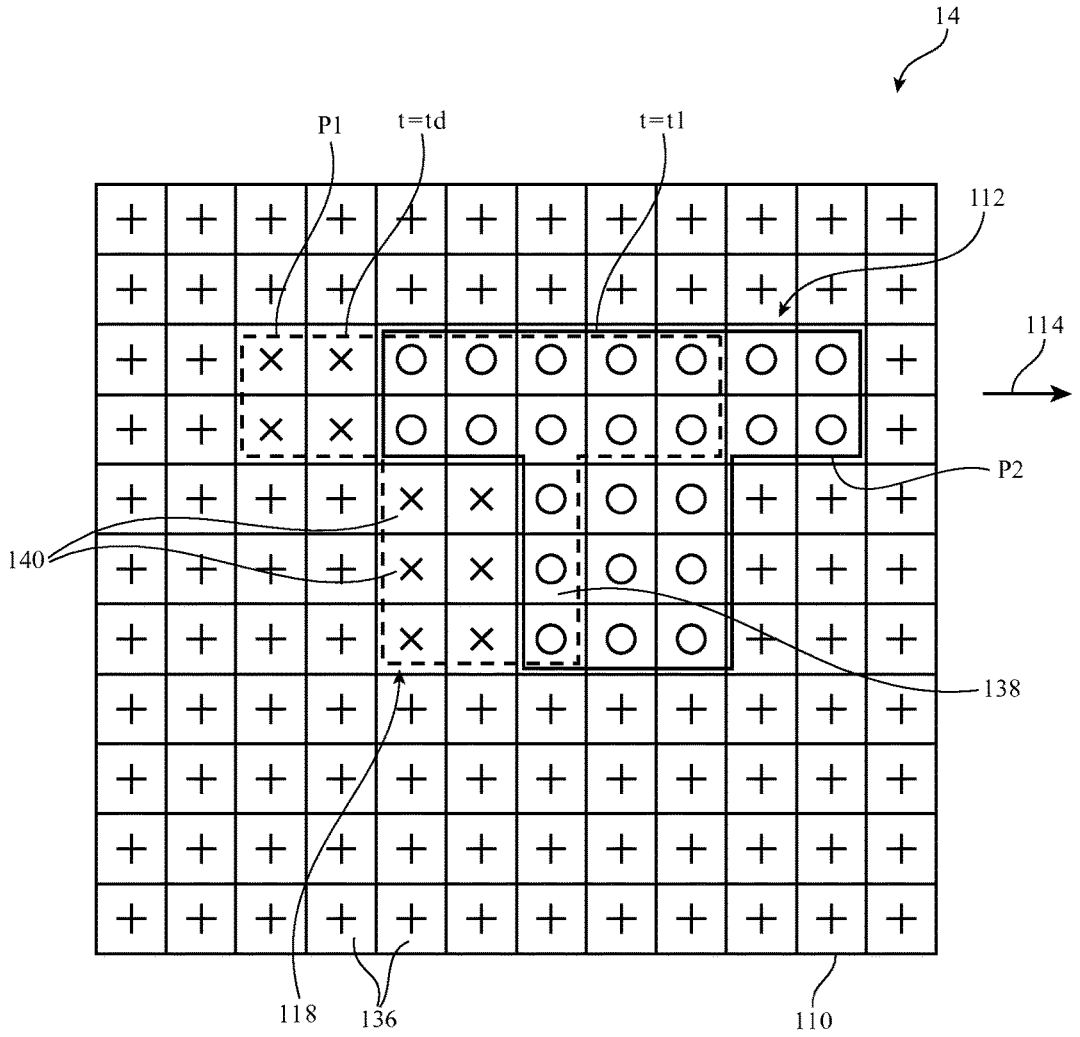
FIG. 10 is a diagram showing how frames of image data may be compared to identify the pixels along the trailing edge of a moving object in accordance with an embodiment.

The diagram of FIG. 10 shows how the pixels of successive frames may be compared to identify which pixels in display 14 make up trailing edge 118. In the example of FIG. 10, object 112 has a first position P1 at time t1 and, by virtue of movement in direction 114, has a second position P2 at time t2. Object pixels 138 are black (in this example) and have subpixel values 128 of FIG. 9. Background pixels 136 are orange (in this example) and have subpixel values 132 (in this example). Trailing edge pixels 140 in trailing edge 118 can be identified by comparing the pixel values of a frame of data containing object 112 in position P1 with the pixel values of a successive frame of data containing object 112 in position P2 or can otherwise be identified by comparing the image data for object 112 in positions P1 and P2. Scenarios in which image processing operations involve comparing frames of successive image pixels to identify which pixels form trailing edge 118 are sometimes described herein as an example. If desired, the leading edge of object 112 may likewise be identified and the pixels of object 112 along its leading edge may be modified to reduce motion blur. Scenarios in which the pixels of the trailing edge of object 112 are modified to reduce color motion blur are described as an illustrative example.

Figure 11:
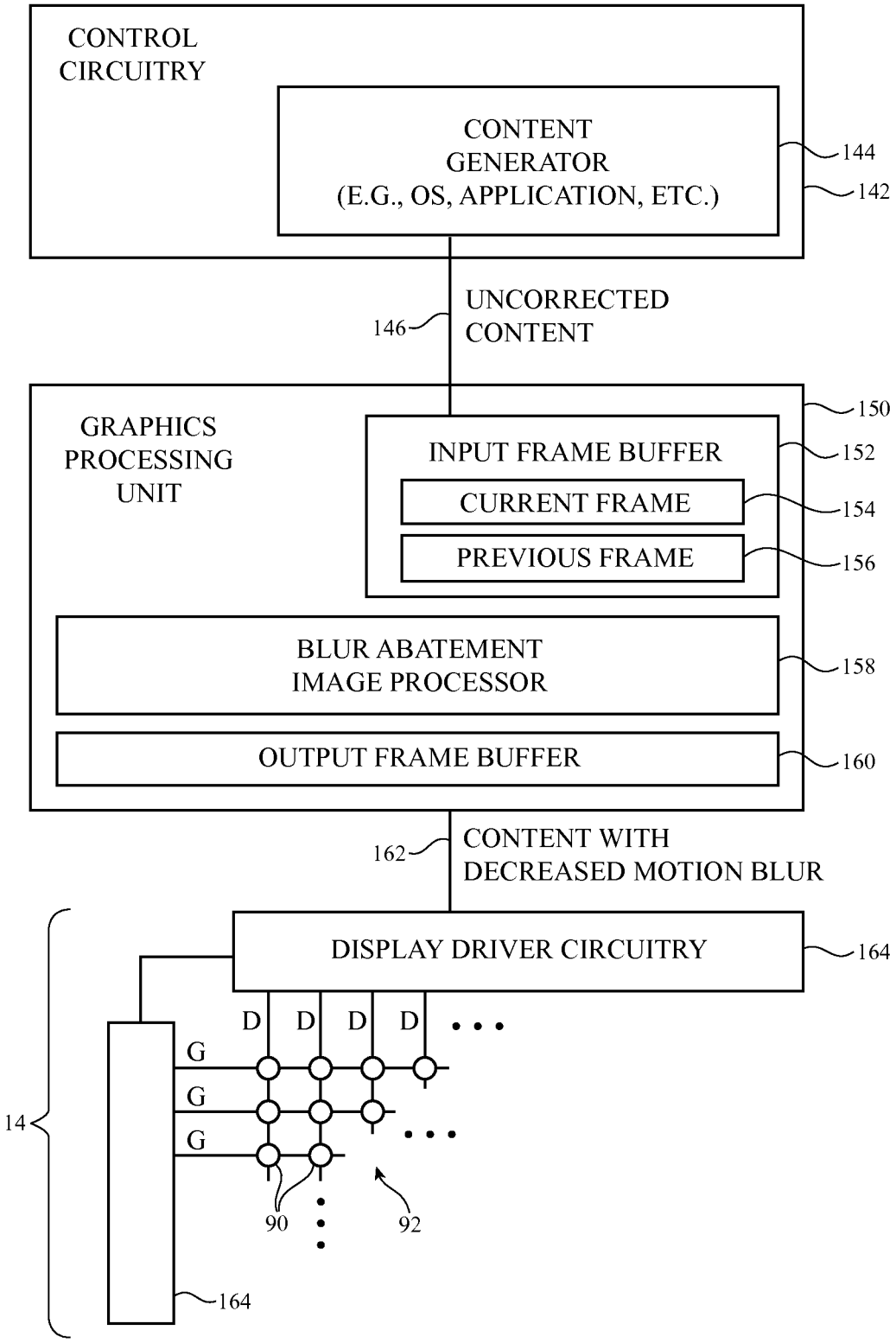
FIG. 11 is a diagram of illustrative circuitry of the type that may be used to modify subpixel values to reduce color motion blur effects in accordance with an embodiment.

A diagram of illustrative resources that may be used in device 10 to reduce color motion blur effects is shown in FIG. 11. As shown in FIG. 11, device 10 may include control circuitry such as control circuitry 142. Control circuitry 142 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 142 may be used to control the operation of device 10. This processing circuitry may be based on one or more microprocessors, microcontrollers, digital signal processors, application specific integrated circuits, etc.

Control circuitry 142 may be used to run software on device 10, such as operating system software, application software, firmware, etc. As shown in FIG. 11, the software running on control circuitry 142 may include code that generates content that is to be presented on display 14 (see, e.g., content generator 144, which may be an operating system function, an e-book reader or other software application, or other code that is running on control circuitry 142). Content generator 144 may generate content that has not been corrected to reduce motion blur effects (uncorrected content) and this content may be supplied to graphics processing unit 150 via path 146.

Graphics processing unit 150 may include an input frame buffer such as buffer 152 or other storage to maintain information on a current image frame 154 and one or more earlier frames such as previous image frame 156. Graphics processing unit 150 may also include an output frame buffer such as output frame buffer 160 that stores content in which certain pixels (e.g., the pixel in trailing edge 118) have been modified to reduce motion blur. Blur abatement image processor (content processor) 158 may be used to process uncorrected content and produce corresponding content in which pixels have been modified to decrease motion blur. The content with decreased motion blur may be supplied to display driver circuitry 164 of display 14 over path 162. Display driver circuitry 164 may include integrated circuit (s) and/or thin-film transistor circuitry on display 14 for displaying the content that is received over path 162 on pixels 90 in pixel array 92 of display 14.

Figure 12:
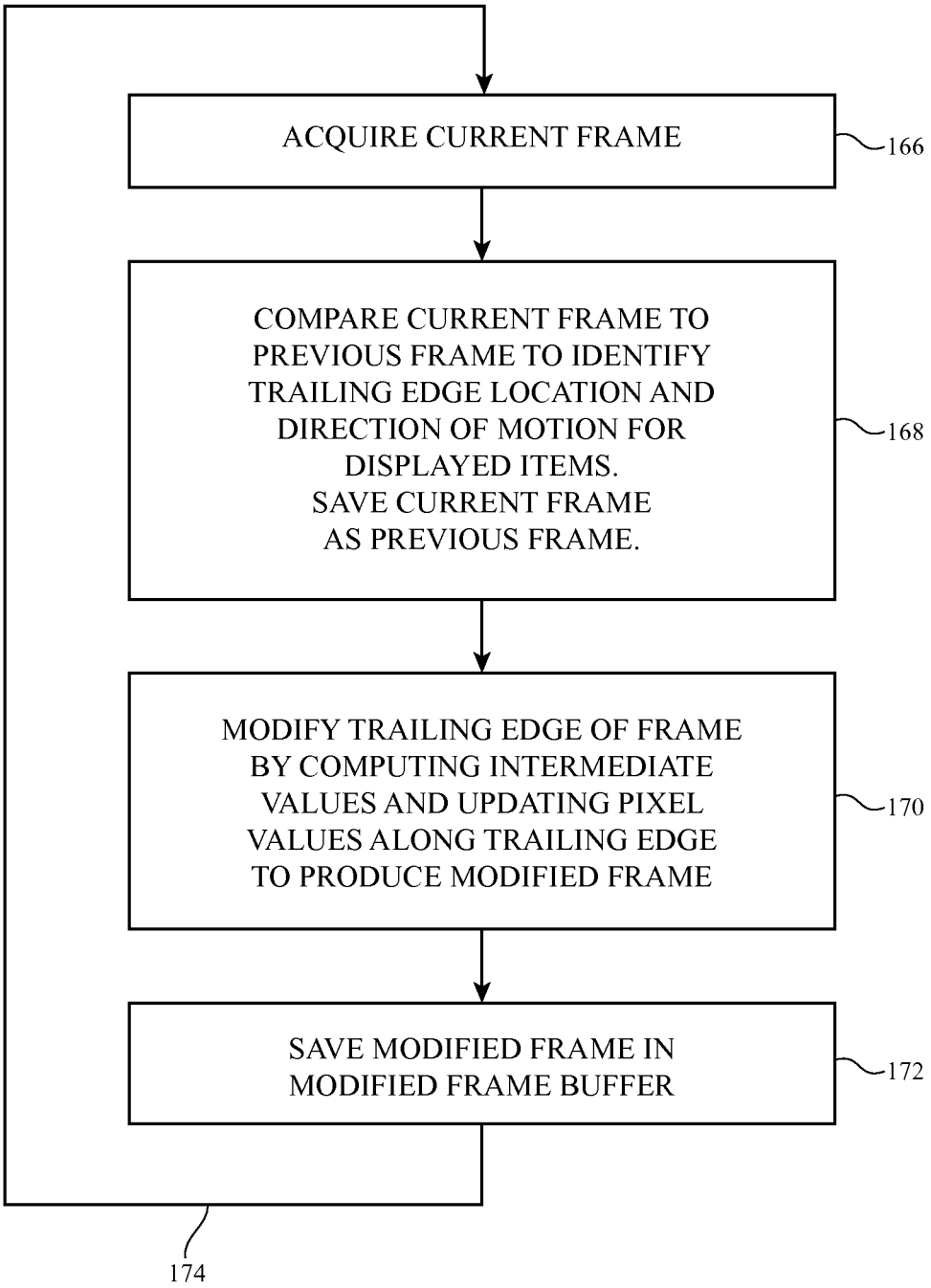
FIG. 12 is a flow chart of illustrative steps involved in analyzing content with moving objects and in modifying certain pixels in the content to reduce color motion blur effects in accordance with an embodiment.

Illustrative operations involved in using resources of the type shown in FIG. 11 in displaying content with reduced motion blur on display 14 are shown in FIG. 12.

Initially, content generator 144 may generate content to be displayed on display 14 and graphics processing unit 150 may receive the content over path 146. The content may include frames of image data. Blur abatement image processor 158, which may be implemented using software and/or hardware resources associated with graphics processing unit 150, may acquire a frame of image data (sometimes referred to as an image frame or content frame) from content generator 144 at step 166.

During the operations of step 168, blur abatement image processor 158 may use frame buffer 152 to store frames of image data including current frame 154 and previous frame 156. Blur abatement image processor 158 may compare the pixel values in current frame 154 and previous frame 156 to identify the location of object 112 and the direction of motion of object 112 relative to background 110 and to identify which pixels are in trailing edge 118, as described in connection with FIG. 10. After each current frame is processed, processor 158 may store the data of the current frame as previous frame 156.

After identifying the location of trailing edge 118 (i.e., after identifying the boundary of edge region 118 and the pixels that are located within this area of the image), blur abatement image processor 158 may adjust the pixel values of the pixels in the trailing edge to reduce motion blur (step 170). In particular, blur abatement image processor 158 may temporarily reduce the values of the red subpixels in trailing edge 118 as described in connection with the creation of temporary intermediate frame F2 of FIG. 9 (i.e., the value of these red subpixels is not increased immediately to the desired final target value of 245, but rather is raised first to an intermediate value). Frames of data that have been processed by blur abatement processor 158 may be stored in output frame buffer 160. The modified frame (i.e., a frame such as frame F2 of FIG. 9 in this example) can be displayed at time t3 of FIG. 8 and the final desired frame (i.e., a frame such as frame F3 of FIG. 9 in this example) can be displayed following frame F1 (i.e., at time t4 of FIG. 8). As indicated by line 144, processing can then loop back to step 166 so that additional content from content generator 144 can be processed.

If desired, the image processing operations involved in implementing the color motion blur abatement process of processor 158 may be implemented in full or in part in control circuitry 142 (e.g., as part of an operating system or application or both an operating system and application), may be implemented in full or in part in display 14 (e.g., using resources in a timing controller integrated circuit or other circuitry in display drier circuitry 164), may be implemented in full or in part on graphics processing unit 150 as described in connection with FIG. 12, and/or may be implemented using other resources in device 10 or any combination of two or three or more of these sets of resources. The use of a scenario in which blur abatement image processor 158 is implemented on graphics processing unit 150 is merely illustrative.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a display having an array of pixels each of which has subpixels of different colors;

control circuitry that generates content to be displayed on the display, wherein the content includes an object that is being moved across a background; and a blur abatement image processor that processes the content to adjust subpixel values for the subpixels and thereby reduce color motion blur as the content is displayed on the display, wherein the blur abatement image processor adjusts a first subpixel value associated with a first color based on a second subpixel value associated with a second color by temporarily setting the first subpixel value to the second subpixel value, wherein the second subpixel value is lower than the first subpixel value before the first subpixel value is adjusted, wherein the first and second subpixel values are associated with a single given pixel of the array of pixels, and wherein the content processed by the blur abatement image processor comprises frames of color image data.

2. The electronic device defined in claim 1 wherein the blur abatement image processor is configured to process the content to identify a trailing edge of the object.

3. The electronic device defined in claim 2 wherein the blur abatement image processor is configured to slow the transition speed of subpixels of a given color in the trailing edge by temporarily using a subpixel value for the given color of subpixel that is lower than a final subpixel value for the given color that is associated with the background.

4. The electronic device defined in claim 3 wherein the given color is red and wherein the blur abatement image processor is configured to slow the transition speed of red subpixels in the trailing edge by temporarily setting the red subpixels to a red subpixel value that is lower than a final red subpixel value associated with the background.

5. The electronic device defined in claim 4 wherein the subpixels include the red subpixels, green subpixels, and blue subpixels and wherein the blur abatement image processor is configured to temporarily set the red subpixels to a red subpixel value that is equal to a subpixel values associated with the green subpixels in the background.

6. The electronic device defined in claim 4 wherein the blur abatement image processor is configured to raise the red subpixel value to the final red subpixel value after temporarily setting the red subpixel value to the red subpixel value that is lower than the final red subpixel value.

7. Apparatus, comprising:

a blur abatement image processor that compares a current color image frame to a previous color image frame to identify a trailing edge of an object being moved across a background and that, in response to detecting the trailing edge of the object being moved across the background, adjusts subpixel values for pixels in the trailing edge to reduce color motion blur by adjusting a first subpixel value associated with a first color based on a second subpixel value associated with a second color by temporarily setting the first subpixel value to the second subpixel value, wherein the first subpixel value is greater than the second subpixel value before it is temporarily set to the second subpixel value, wherein the first and second subpixels are associated with a single given pixel of the pixels; and a display on which color images frames that have been processed by the blur abatement image processor are displayed.

8. The apparatus defined in claim 7 wherein the display has an array of pixels, wherein the pixels each include a red subpixel, a green subpixel, and a blue subpixel, wherein the object is a black object, wherein the background has a background color with a red subpixel value, a green subpixel value, and a blue subpixel value, and wherein the blur abatement image processor is configured to transition the red subpixels in the trailing edge from a first value associated with the black object to the red subpixel value of the background color by temporarily setting the red subpixels in the trailing edge to an red subpixel value that is lower than the red subpixel value of the background color and subsequently setting the red subpixels in the trailing edge to the red subpixel value of the background color.

9. The apparatus defined in claim 8 wherein red subpixel value that is lower than the red subpixel value of the background color is equal to the green subpixel value of the background color.

10. A method of displaying color content on a display having an array of pixels each having subpixels of different colors, comprising:

reducing color motion blur in response to detecting that an object is moved across a background on the display by adjusting subpixel values associated with at least some of the subpixels, wherein adjusting the subpixel values comprises:

adjusting a first value associated with a first subpixel of a first color based on a second value associated with a second subpixel of a second color by setting the first value to the second value, wherein the first value is greater than the second value before it is adjusted, wherein the first and second subpixels are associated with a single given pixel of the array of pixels.

11. The method defined in claim 10 further comprising:

processing the color content to identify a trailing edge of the object.

12. The method defined in claim 11 wherein reducing the color motion blur comprises adjusting subpixel values for subpixels associated with pixels in the trailing edge.

13. The method defined in claim 12 wherein subpixels of a given one of the different colors have a background subpixel value in the background and wherein adjusting the subpixel values comprises:

setting subpixels of the given color that are associated with the pixels in the trailing edge to a subpixel value that is lower than the background subpixel value; and after setting the subpixels of the given color that are associated with the pixels in the trailing edge to the subpixel value that is lower than the background subpixel value, setting the subpixels of the given color that are associated with the pixels in the trailing edge to the background subpixel value.

14. The method defined in claim 13 wherein the given color is red and wherein setting the subpixels of the given color that are associated with the pixels in the trailing edge to the subpixel value that is lower than the background subpixel value comprises setting red subpixels that are associated with the pixels in the trailing edge to a red subpixel value that is lower than a red background subpixel value.

15. The method defined in claim 14 wherein setting the red subpixels to the red subpixel value comprises adjusting the red subpixel value to be equal to a green subpixel value associated with green subpixels in the background.

16. The method defined in claim 11 wherein reducing the color motion blur comprises slowing the transition speed of red subpixels by temporarily setting the red subpixels of pixels in the trailing edge to a red subpixel value that is less than a final red subpixel value associated with the background.

17. The method defined in claim 16 further comprising:

raising the red subpixel values from the red subpixel value that is less than the final red subpixel value to the final red subpixel value so that the trailing edge has a color matching the background.

18. The method defined in claim 11 wherein processing the color content comprises comparing pixels in a current frame of the color content to pixels in a previous frame of the color content to identify the trailing edge.

19. The method defined in claim 11 wherein the subpixels include red subpixels, green subpixels, and blue subpixels, wherein the object is a black object, wherein the background has a background color with a red subpixel value, a green subpixel value, and a blue subpixel value, and wherein reducing the color motion blur comprises:

transitioning the red subpixels in the trailing edge from a first value associated with the black object to the red subpixel value of the background color by temporarily setting the red subpixels in the trailing edge to an red subpixel value that is lower than the red subpixel value of the background color and subsequently setting the red subpixel value to the red subpixel value of the background color.

20. The method defined in claim 19 wherein red subpixel value that is lower than the red subpixel value of the background color is equal to the green subpixel value of the background color.

* * * * *